US006957448B2

(12) United States Patent
Grilliot et al.

(10) Patent No.: US 6,957,448 B2
(45) Date of Patent: Oct. 25, 2005

(54) PROTECTIVE GLOVE HAVING EDGE STRIP WIDENED AT SPECIFIC REGIONS

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 206 days.

(21) Appl. No.: 10/291,962

(22) Filed: Nov. 12, 2002

(65) Prior Publication Data

US 2004/0088776 A1 May 13, 2004

(51) Int. Cl.[7] ..... A41D 19/00
(52) U.S. Cl. ..... 2/161.6; 2/163
(58) Field of Search ..... 2/160, 161.6, 161.8, 2/163

(56) References Cited

U.S. PATENT DOCUMENTS 1,625,368 A * 4/1927 Kurz ..... 2/169
2,125,673 A * 8/1938 Geissmann ..... 2/159
4,000,524 A * 1/1977 Rinehart ..... 2/161.6
4,654,896 A * 4/1987 Rinehart ..... 2/163
5,822,796 A * 10/1998 Harges et al. ..... 2/161.6
6,415,443 B1 * 7/2002 Schierenbeck et al. ..... 2/159
6,427,250 B1 * 8/2002 Stull et al. ..... 2/161.6
6,732,378 B2 * 5/2004 Novak ..... 2/161.6

* cited by examiner

*Primary Examiner*—Katherine M Moran
(74) *Attorney, Agent, or Firm*—Wood, Phillips, Katz, Clark & Mortimer

(57) ABSTRACT

In a protective glove, such as a firefighter's or welder's glove, which has a main portion, a thumb-covering portion, and four finger-covering portions and in which each portion has a front face and a back face and each face having a periphery, an edge strip joining the peripheries of the front and back faces of the of the main, thumb, and finger portions has two elongate edges, which are equidistant when the edge strip is taut, except in specific regions, where the protective glove when worn covers the wearer's knuckles and where the protective glove when worn covers the heel of the wearer's hand, at which regions the edge strip is widened to facilitate flexing without binding. Preferably, those regions where the edge strip is widened are located along a single one of the elongate edges, namely, the elongate edge joined to the peripheries of the back faces of the main, thumb, and finger portions.

4 Claims, 3 Drawing Sheets

FIG. 5
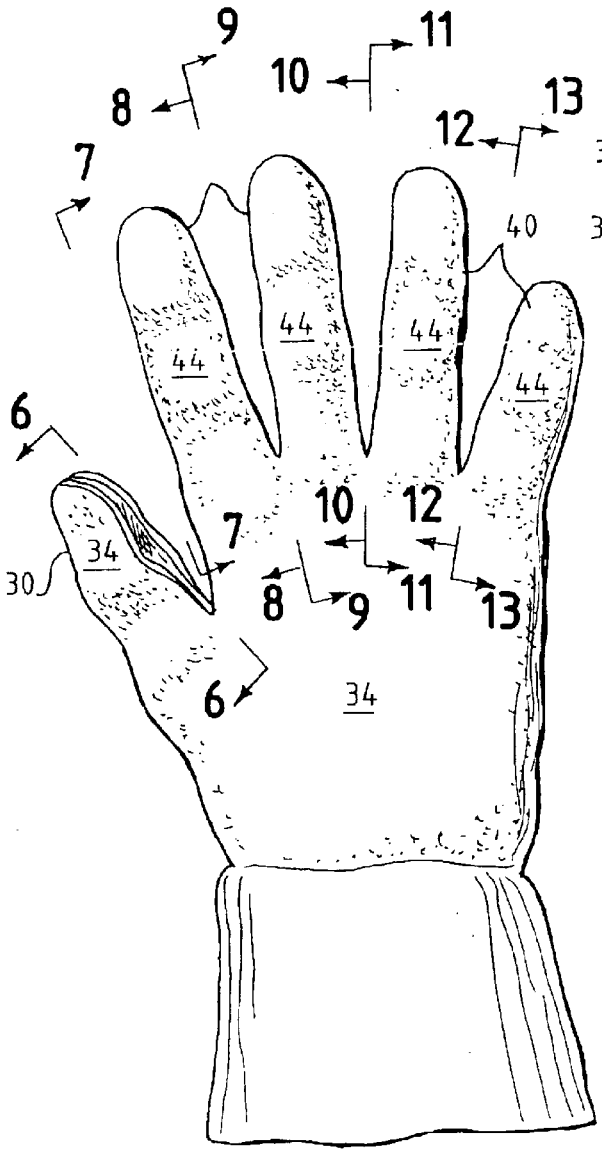
FIG. 6
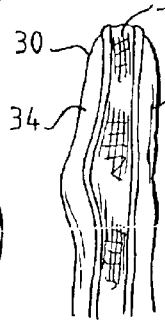
FIG. 7
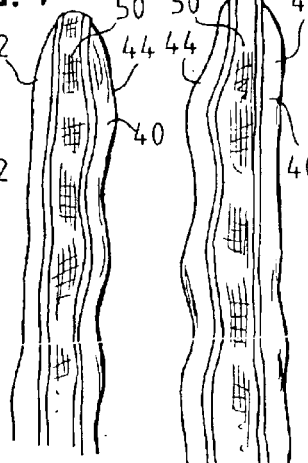
FIG. 8
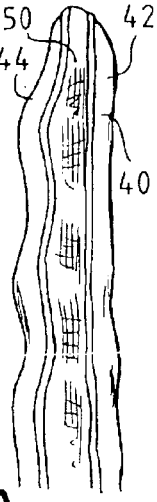
FIG. 9
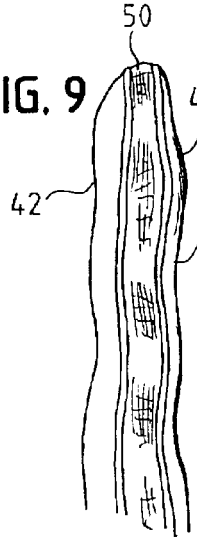
FIG. 10
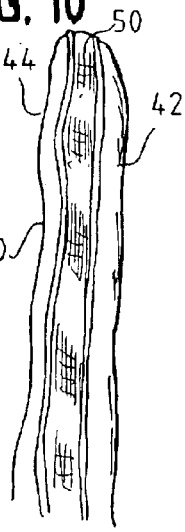
FIG. 11
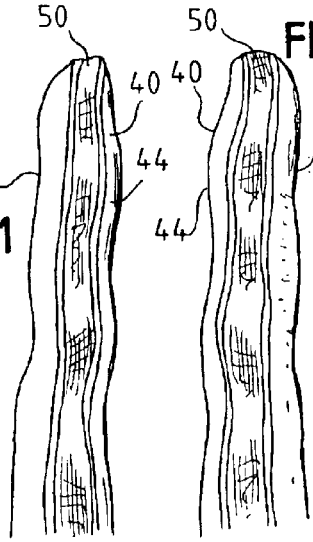
FIG. 12
FIG. 13
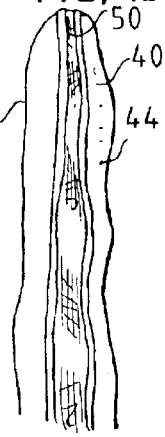

FIG. 14
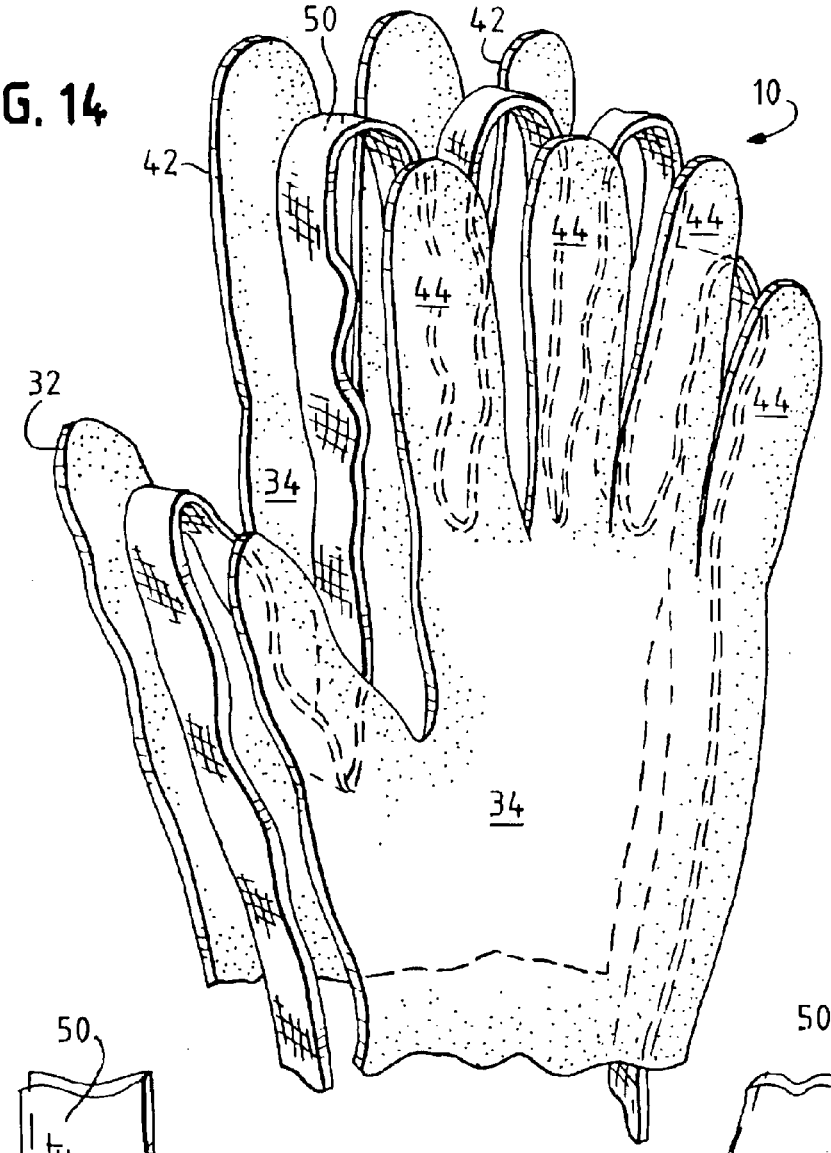
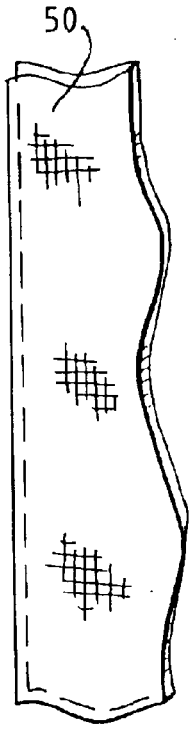
FIG. 15
FIG. 16
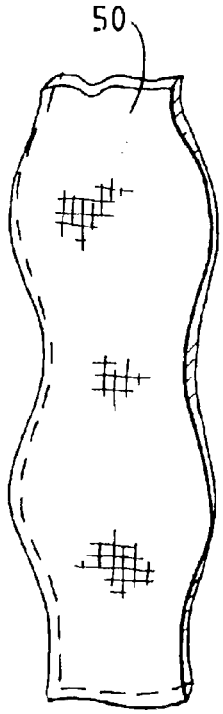

PROTECTIVE GLOVE HAVING EDGE STRIP WIDENED AT SPECIFIC REGIONS

TECHNICAL FIELD OF THE INVENTION

This invention pertains to a protective glove, particularly but not exclusively an insulated glove, such as a firefighter's glove or a welder's glove. This invention contemplates that the protective glove has an edge strip that is widened at specified regions to facilitate flexing without binding.

BACKGROUND OF THE INVENTION

Commonly, a protective glove, particularly but not exclusively an insulated glove, such as a firefighter's glove, has a main portion, a thumb portion, and four finger portions, each portion having a front face and a back face and each portion having a periphery. Commonly, such a glove has an edge strip joining the peripheries of the front and back faces of the main, thumb, and finger portions and having two elongate edges, which are equidistant when the edge strip is taut.

As exemplified in U.S. Pat. No. 6,415,443, the disclosure of which is incorporated herein by reference, it is known for each of the thumb-covering and finger-covering portions to have a generally uniform width except at its tip, and except for knuckle-covering regions that are wider to facilitate flexing without binding.

Protective gloves of related interest are disclosed in U.S. Pat. No. 4,918,756 and in other United States patents identified in U.S. Pat. No. 6,415,443, in column 1, lines 9 through 26.

SUMMARY OF THE INVENTION

This invention provides a protective glove having a main portion, a thumb-covering portion, and four finger-covering portions. Each portion has a front face and a back face. The protective glove has an edge strip joining the front and back faces of the main, thumb, and finger portions at the peripheries of those faces. The edge strip has two elongate edges, which are equidistant when the edge strip is taut, except at specific regions where the edge strip is widened to facilitate flexing of the protective glove without binding when the protective glove is worn.

Preferably, those regions where the edge strip is widened are located along a single one of the elongate edges. In a preferred embodiment, those regions where the edge strip is widened are located along the elongate edge joined to the peripheries of the back faces of the main, thumb, and finger portions. Preferably, those regions where the edge strip is widened are located where the protective glove when worn covers the wearer's knuckles and where the protective glove when worn covers the heel of the wearer's hand.

BRIEF DESCRIPTION OF THE DRAWINGS

FIG. 5 is an elevation of the protective glove, as taken to show a back face of the main portion, to show a back face of the thumb-covering, and to show a back face of each finger-covering portion.

FIGS. 6 though 13 are fragmentary, sectional views, as taken along correspondingly numbered lines in FIG. 5, each in a direction indicated by arrows.

FIG. 14 is an exploded view of the protective glove, as taken to show the edge strip prior to assembly of the glove.

FIGS. 15 and 16 depict embodiments of the edge strip of the protective glove.

DETAILED DESCRIPTION OF THE DRAWINGS

Figure 1:
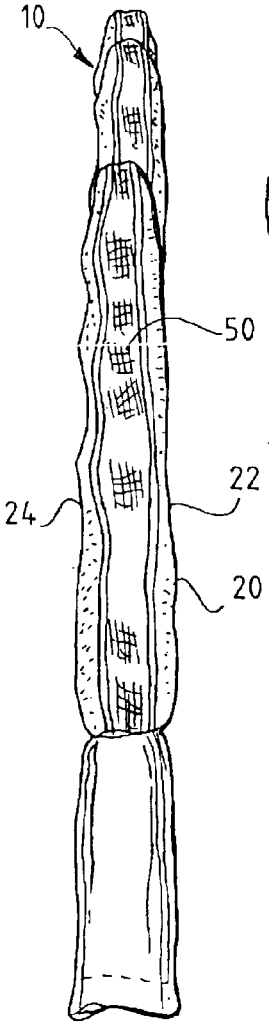
FIG. 1 is an elevation of a protective glove embodying this invention, as taken to show a front face of a main portion of the protective glove, to show a front face of a thumb-covering portion of the protective glove, and to show a front face of each finger-covering portion of the protective glove.
Figure 2:
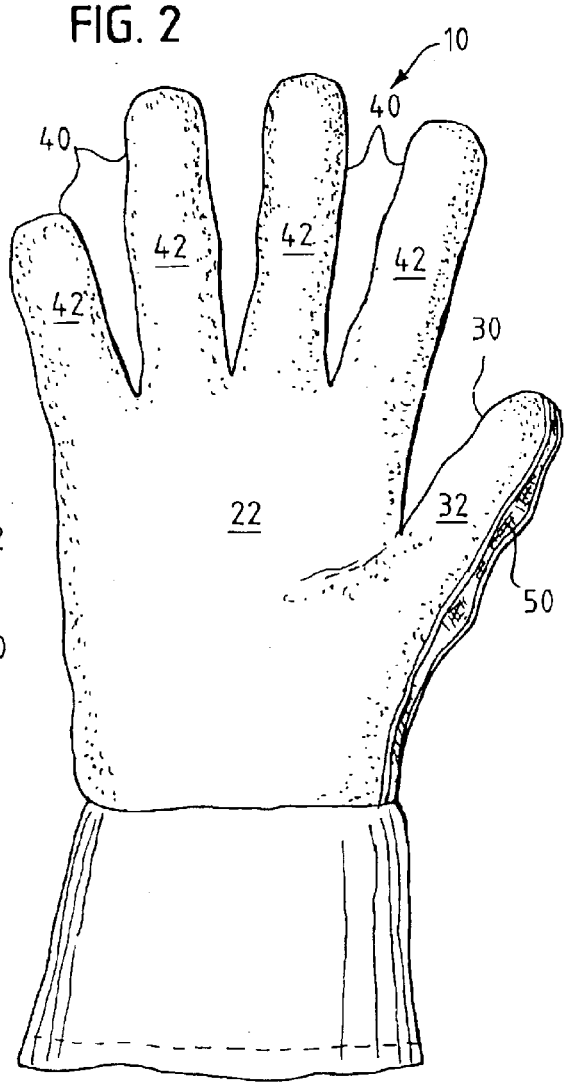
FIG. 2 is an elevation of the protective glove, as taken to show its left edge in FIG. 1.
Figure 3:
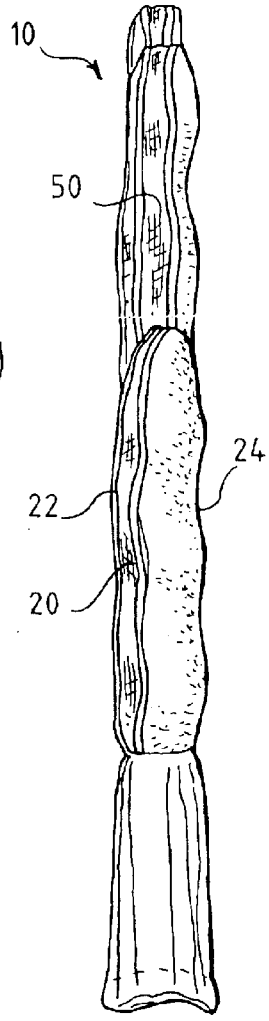
FIG. 3 is an elevation of the protective glove, as taken to show its right edge in FIG. 1.
Figure 4:
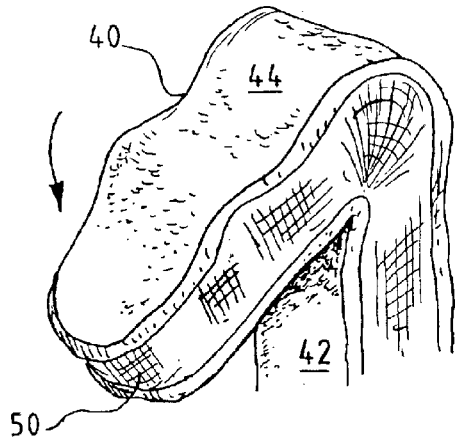
FIG. 4, on a larger scale, is a fragmentary detail showing how one finger-covering portion can flex.

As illustrated, a protective glove 10 constituting a preferred embodiment of this invention, has a main portion 20, which has a front face 22 and a back face 24, a thumb-covering portion 30, which has a front face 32 and a back face 34, and four finger-covering portions 40, each of which has a front face 42 and a back face 44. The front face 22 is intended to cover the palm of a wearer's hand and the back face 34 is intended to cover the back of the wearer's hand. The protective glove 10 has an edge strip 50 having two elongate edges 52, 54, along which the edge strip 50 is joined, as by sewing, to the peripheries of the front and back faces 22, 24, of the main portion 20, to the peripheries of the front and back faces 32, 34, of the thumb-covering portion 30, and to the peripheries of the front and back faces 42, 44, of each finger-covering portion 40. Each of the main, thumb-covering, and finger-covering portions 20, 30, 40, may comprise plural layers, such as a waterproof layer, a thermally insulative layer, and an abrasion-resistant layer. The edge strip 50 may comprise similar layers. Each layer may comprise a single piece or may comprise plural pieces sewn or bonded to one another.

As far as described in the preceding paragraph, the protective glove 10 is similar to protective gloves, such as firefighters' gloves and welders' gloves, as known heretofore. As contemplated by this invention the protective glove 10 differs from protective gloves, such as firefighters' gloves and welders' gloves, as known heretofore, because the elongate edges 52, 54, of the edge strip 50, are equidistant when the edge strip 50 is taut, except at specific regions 56 along the elongate edge 54 joined to the back faces 24, 34, 44, of the main, thumb, and finger portions 20, 30, 40, where the protective glove 10 when worn covers the wearer's knuckles and where the protective glove 10 when worn covers the heel of the wearer's hand. This invention contemplates that the edge strip 50 is widened at those regions 56 to facilitate flexing of the protective glove 10 without binding when the protective glove 10 is worn.

In an alternative embodiment, as seen in FIG. 16, the edge strip 50 is widened similarly at specific regions along both elongate edges 52, 54, where the protective glove 10 when worn covers the wearer's knuckles and where the protective glove 10 when worn covers the heel of the wearer's hand, to facilitate flexing of the protective glove 10 without binding when the protective glove 10 is worn.

What is claimed is:

1. A protective glove having a main portion, a thumb-covering portion, and four finger-covering portions, each portion having a front face and a back face and each face having a periphery, the protective glove having an edge strip joining the peripheries of the front and back faces of the main, thumb-covering, and finger-covering portions, the edge strip having two elongate edges, which are equidistant when the edge strip is taut, except at specific regions where the edge strip is widened to facilitate flexing of the protective glove without binding when the protective glove is worn, wherein those regions where the edge strip is widened are located along a single one of the elongate edges.

2. The protective glove of claim 1 wherein those regions where the edge strip is widened are located along the elongate edge joined to the peripheries of the back faces of the main, thumb, and finger portions.

3. The protective glove of claim 1 or 2 wherein those regions where the edge strip is widened include regions located where the protective glove when worn covers the wearer's knuckles.

4. The protective glove of claim 1 or 2 wherein those regions where the edge strip is widened include regions located where the protective glove when worn covers the wearer's knuckles and where the protective glove when worn covers the heel of the wearer's hand.

* * * * *